US008701646B2

(12) United States Patent
Boyko et al.

(10) Patent No.: US 8,701,646 B2
(45) Date of Patent: Apr. 22, 2014

(54) SYSTEM AND METHOD FOR CUTTING CERAMIC WARE

(75) Inventors: Ronald Alan Boyko, Elmira, NY (US); George Peter Pesansky, Port Orange, FL (US)

(73) Assignee: Corning Incorporated, Corning, NY (US)

( * ) Notice: Subject to any disclaimer, the term of this patent is extended or adjusted under 35 U.S.C. 154(b) by 482 days.

(21) Appl. No.: 12/918,857

(22) PCT Filed: Feb. 27, 2009

(86) PCT No.: PCT/US2009/001236
§ 371 (c)(1),
(2), (4) Date: Nov. 16, 2010

(87) PCT Pub. No.: WO2009/108343
PCT Pub. Date: Sep. 3, 2009

(65) Prior Publication Data

US 2011/0041827 A1 Feb. 24, 2011

Related U.S. Application Data

(60) Provisional application No. 61/067,602, filed on Feb. 29, 2008.

(51) Int. Cl.
*B28D 1/02* (2006.01)

(52) U.S. Cl.
USPC ..... 125/13.01; 125/13.02; 125/20; 451/41

(58) Field of Classification Search
USPC ..... 125/13.01, 13.02, 20; 451/41
See application file for complete search history.

(56) References Cited

U.S. PATENT DOCUMENTS

| | | | | | |
|---|---|---|---|---|---|
| 3,491,742 | A * | 1/1970 | Weiss | 125/15 |
| 4,407,263 | A * | 10/1983 | Murata | 125/15 |
| 4,633,847 | A * | 1/1987 | Lossl et al. | 125/16.01 |
| 4,962,748 | A * | 10/1990 | Schweickhardt | 125/13.01 |
| 5,095,885 | A * | 3/1992 | Komatsuzaki | 125/13.02 |
| 6,102,023 | A * | 8/2000 | Ishiwata et al. | 125/13.01 |
| 6,422,227 | B1 * | 7/2002 | Kobayashi et al. | 125/13.01 |

(Continued)

FOREIGN PATENT DOCUMENTS

| | | | | |
|---|---|---|---|---|
| JP | 61-152375 | | 7/1986 | |
| JP | 07001341 | A * | 1/1995 | B24D 5/12 |

(Continued)

*Primary Examiner* — Maurina Rachuba
(74) *Attorney, Agent, or Firm* — Charles A. Greene; Joseph M. Homa; Matthew J. Mason

(57) ABSTRACT

Cutting and grinding of ceramic-type logs to a desired piece length is disclosed. A method of manufacturing ceramic ware is disclosed which comprises transversely cutting a piece from a ceramic-type log having a longitudinal axis by cutting into the log with a blade at a location along the length of the log to form a cut transverse surface on the piece and grinding the cut transverse surface with a side of the blade. An apparatus for manufacturing ceramic ware is also disclosed comprising means for transversely cutting a piece from a ceramic-type log having a longitudinal axis, including a blade for cutting into the log at a location along the length of the log to form a cut transverse surface on the piece, and means for grinding the cut transverse surface with a side of the blade.

16 Claims, 2 Drawing Sheets

(56) References Cited

U.S. PATENT DOCUMENTS

| | | | | |
|---|---|---|---|---|
| 6,595,845 | B1 * | 7/2003 | Mizuno et al. | 125/15 |
| 6,877,502 | B2 * | 4/2005 | Register | 125/13.01 |
| 6,945,850 | B2 * | 9/2005 | Perrey | 451/28 |
| 7,143,759 | B1 * | 12/2006 | Wang | 125/13.01 |
| 2003/0203538 | A1 * | 10/2003 | Peng et al. | 125/23.01 |
| 2005/0268763 | A1 * | 12/2005 | Peng et al. | 125/12 |
| 2009/0126711 | A1 * | 5/2009 | Gomez | 125/15 |

FOREIGN PATENT DOCUMENTS

| | | |
|---|---|---|
| JP | 07-251321 | 10/1995 |
| JP | 2006-068998 | 3/2006 |
| WO | 2004071697 | 8/2004 |

* cited by examiner

SYSTEM AND METHOD FOR CUTTING CERAMIC WARE

RELATED APPLICATIONS

This application claims the benefit of U.S. Provisional Application No. 61/067,602, filed Feb. 29, 2008, entitled "System and Method for Cutting Ceramic Ware."

FIELD

The present invention relates to the manufacture of ceramic ware, and more particularly to cutting pieces from a generally cylindrical ceramic-type honeycomb body.

BACKGROUND

Fired ceramic logs have been cut into pieces using a water-cooled single-bladed saw; then the pieces were ground to the exact length by passing them through water-cooled, fixed grinding wheels in a separate process step; then washed clean of saw dust; and then dried in a lehr-type dryer in a fourth process step.

SUMMARY

The present invention relates to the cutting and grinding of ceramic-type logs (such as generally cylindrical green ceramic-forming bodies) to a desired piece length, either from parent logs or from longer pieces to shorter ones.

In one aspect, the present invention relates to a method of manufacturing ceramic ware, the method comprising transversely cutting a piece from a ceramic-type log having a longitudinal axis by cutting into the log with a blade at a location along the length of the log to form a cut transverse surface on the piece and grinding the cut transverse surface with a side (i.e. transverse surface) of the blade.

In another aspect, the present invention relates to an apparatus for manufacturing ceramic ware, the apparatus comprising means for transversely cutting a piece from a ceramic-type log having a longitudinal axis, including a blade for cutting into the log at a location along the length of the log to form a cut transverse surface on the piece, and means for grinding the cut transverse surface with a side (i.e. transverse portion) of the blade.

Embodiments of the present invention utilize a two-bladed saw to cut dry green logs into pieces and grind them to exact length prior to firing, and preferably remove the saw dust from them, all in one enclosed operation.

DETAILED DESCRIPTION

Figure 1:
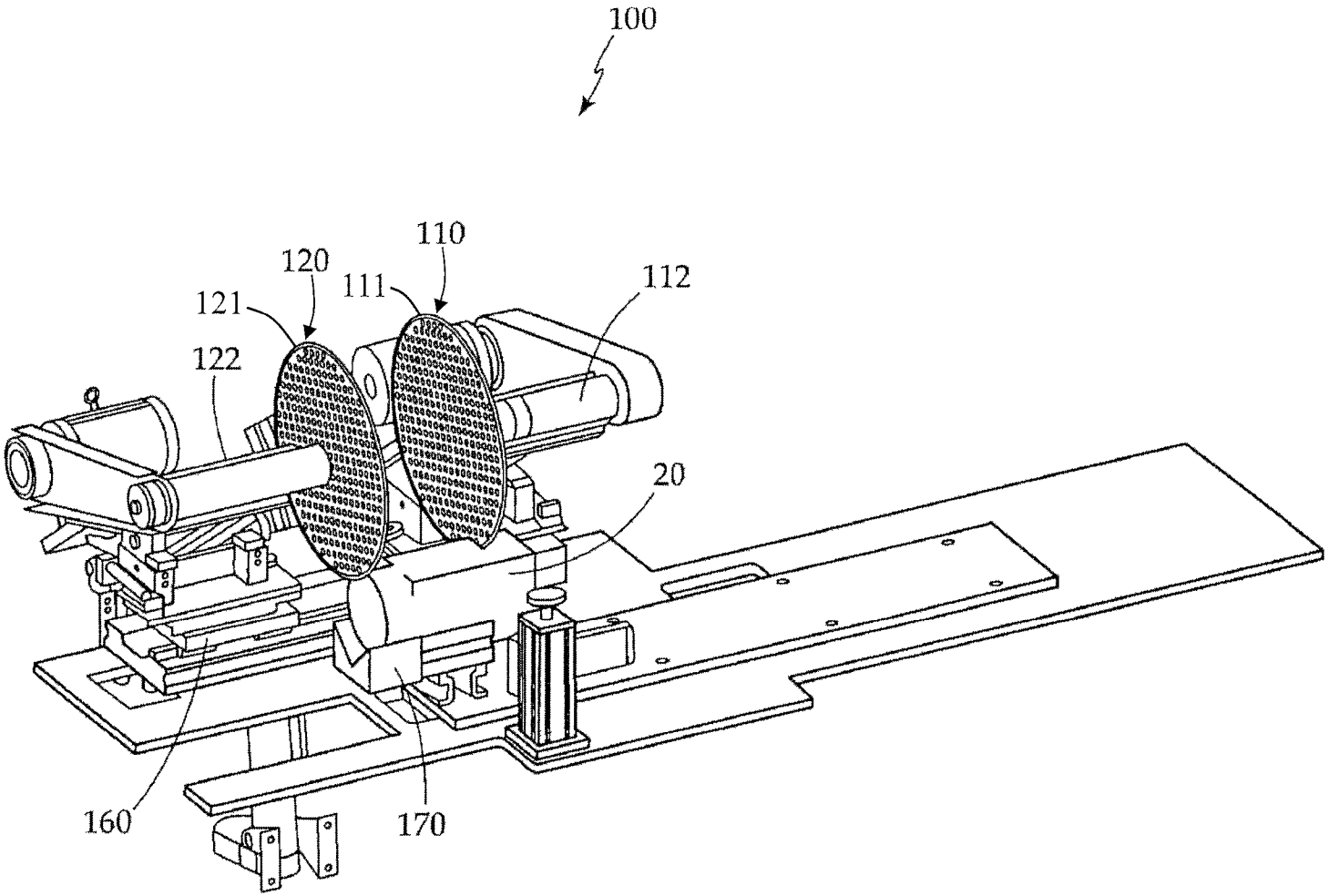
FIG. 1 is a perspective view of the front of an apparatus for cutting and grinding as disclosed herein.
Figure 2:
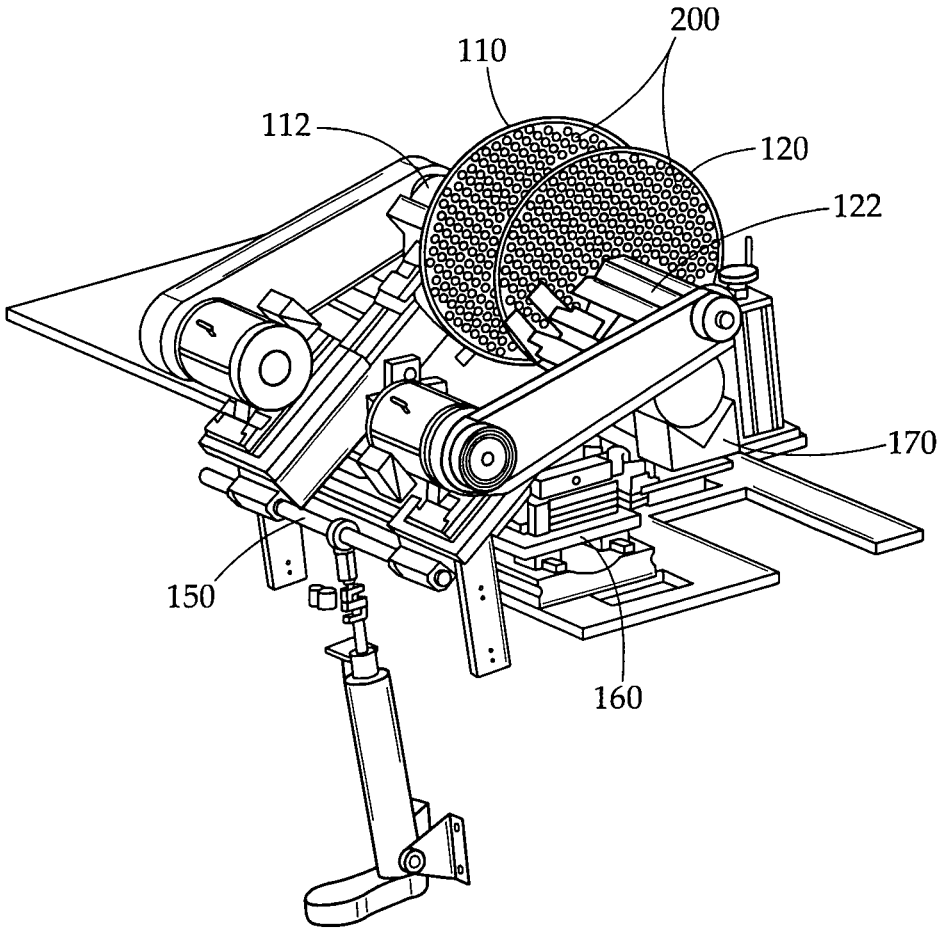
FIG. 2 is a perspective view of the rear of the apparatus of FIG. 1.

In one aspect, the present invention relates to a method of manufacturing ceramic ware, the method comprising: transversely cutting a piece from a ceramic-type log having a longitudinal axis by cutting into the log with a blade at a location along the length of the log to form a cut transverse surface on the piece and grinding the cut transverse surface with a side of the blade, i.e. while the cut transverse surface is proximate the first location.

The grinding can further comprise bringing the side of the blade into contact with the cut transverse surface of the piece. In some embodiments, the blade is indexed longitudinally toward the piece to bring the blade into contact with the piece. In some embodiments, the side of the blade comprises abrasive regions and non-abrasive regions; in some of these embodiments, the abrasive regions and non-abrasive regions form a pattern on the transverse surface of the blade.

Preferably, the blade is moved forward from a ready position to a forward position to cut the piece, and the blade is moved backward from the forward position to the ready position after the piece is cut, and the grinding occurs before the blade is moved backward. Preferably, the grinding occurs before the blade is moved back to the ready position. In some embodiments, the blade moves between the ready position and the forward position at a plurality of angular speeds.

In some embodiments, a plurality of blades cut into the log at a plurality of locations along the length of the log. For example, first and second blades cut into the log at respective first and second locations along the length of the log, wherein the first and second blades comprise respective first and second grinding surfaces on respective sides, and wherein the first and second blades are indexed toward each other to grind the piece with the first and second grinding surfaces. Preferably, the first and second blades cut into the log simultaneously. Preferably, the first and second blades grind the piece simultaneously.

The ceramic-type log can be a green ceramic-forming log (comprised of ceramic-forming composition). In preferred embodiments, the log is a honeycomb structure, and the pieces cut therefrom are also honeycomb structures.

In another aspect, the present invention relates to an apparatus for manufacturing ceramic ware, the apparatus comprising: means for transversely cutting a piece from a ceramic-type log having a longitudinal axis, including a blade for cutting into the log at a location along the length of the log to form a cut transverse surface on the piece; and means for grinding the cut transverse surface with a side of the blade. The apparatus preferably further comprises means for indexing the blade longitudinally toward the piece to bring the blade into contact with the piece. Preferably, the side of the blade comprises abrasive regions and non-abrasive regions; preferably, the abrasive regions and non-abrasive regions form a pattern on the side of the blade. The apparatus further preferably comprises means for moving the blade forward from a ready position to a forward position to cut the piece, and for moving the blade backward from the forward position to the ready position after the piece is cut.

Thus, in some embodiments, the means for cutting can comprise a saw assembly 100 that uses two saw blades 110, 120 with respective outer cutting edges 111, 121. The two saw blades 110 and 120 are on separate spindles 112, 122 that are linked together by a linkage assembly 150 to cut a piece to its proper length from a horizontal log 20 in one stroke. Further length and dimensional accuracy, as well as surface finish improvement can be realized through its grinding mechanism, achieved by indexing the blades (whose sides contain a grinding medium) towards each other using a rotary actuator and slide mechanism 160 while in the "forward" position, thus grinding both faces of the piece simultaneously with the sides of the blades. When the blades return to the "ready" position, the piece is automatically extracted, turned to a vertical orientation, passed through an air-powered cleaning system to remove saw dust, and then placed on a conveyor belt or other surface.

Dry, green-piece cutting, from dried green ceramic-forming logs, allows green pieces to be loaded onto kiln cars and fired in the vertical position, which has been shown to improve fired-piece shape. Such a dry, 2-bladed, green-grind system described herein reduces 4 process steps of conventional methods to a single process step and preferably eliminates an entire water, particle filtration, and drainage system.

Two-bladed cutting can precisely establish the length of the piece in one single stroke. Grinding of green pieces ("green-grinding") adds further precision to the length of the piece and provides a very high-quality cut surface. Green grinding can be more effective than fired-piece grinding, and is preferred, as green grinding also helps eliminate perpendicularity problems, double-plane cuts, saw blade ripples, and edge chipping.

Precise log indexing via a pusher mechanism reduces end trim and saw kerf waste. The green-piece cutting process with its precise log pusher mechanism, when linked to the forming process, allows immediate feedback to extrusion to allow real-time adjustments in log length to reduce end trims and scrap. This cutting process can advantageously be completely automated.

Log loading into the saws can be either manual log loading or completely automatic log loading using robots, gantry systems, or other pick and place devices. Logs are placed into a V-chuck 170 of hardened material which supports the log during "pushing" and cutting.

Referring to the embodiment in the Figures, two vertical blades 110, 120 mounted on separately powered spindles 112, 122 are attached to pivoting heads, and set at a precise distance apart to define the piece length. The distance between the blades (for example, from 2" to 24") can be varied according to product length by either a manual or automatically adjusted system. The saw 100 can also automatically make the adjustment when the product information is downloaded to the saw assembly via software.

Saw blades 110 and 120, which in some embodiments can be 18"-48" in diameter, cut with respective cutting edges 111 and 121 of abrasive diamond grit and grind with a diamond grit coating 200 on the sides of the blade. Several different geometries and diamond matrices can be used for the cutting edge. Also, several different patterns of diamond coating on the side of the blades can be used, from stripes, to spirals, to dots, etc.

Piece grinding is achieved by indexing the blades towards each other and grinding the piece faces with the diamond grit on the sides of the saw blades. Two assemblies comprised of the blade, spindle, head, and motor are attached to separate mechanical slides which employ a rotary actuator mechanism to move them inward toward each other by the precise distance desired for grinding. The amount of material to be ground from the pieces can be varied by adjusting the distance the assemblies are indexed, for example from 0" to 1" or more.

A hold-down mechanism is preferably used to hold the piece firmly in place during the grinding cycle to stop the piece from rattling or rotating during the grinding cycle. The hold-down mechanism can also be used to hold the piece while the cut is being made. Contact with the piece is achieved either through a pliable pad or air bladder.

Indexing the logs into a precise position under the blades is achieved by an automatic pusher mechanism which uses either a compumotor, servo drive, or other such precision system to push the log. The distance of each "push" is either manually or automatically set according to the desired product. The distance of each push can also be varied to adjust the amount of desired end trim taken on the leading edge of each piece. For example: (a) the first piece of the log can be moved 0"-6" or more past the farthest blade to cut off a disposable end trim segment; (b) moving the log ¼"-1" past the farthest blade can create a green kiln setter cookie; (c) moving the log past the farthest blade a slight distance (<¼") can create a disposable sliver; (d) moving the log so the leading edge of the log is exactly under the farthest blade results in no sliver being cut and only blade kerf being removed; (e) moving the log just shy of the farthest blade results in single-blade cutting.

A cut piece is removed from under the blades when the log pusher pushes the cut piece with the leading face of the remainder of the uncut log. The newly-cut piece is pushed past the blades onto a short V-chuck section which preferably approximates the length of the piece.

End trims can be removed by first or second methods.

The first method uses a fixed V-chuck section between the blades (the V-chuck section being slightly shorter than the piece length to allow blade clearance). The leading edge of the log is pushed past the first blade by the desired distance and a stroke is made to cut the end trim. The log is pushed again under the blades to cut the first piece with the desired amount of sliver or cookie. As the next push pushes the log under the blades, it pushes the newly-cut piece onto the exit V-chuck, and pushes the end trim past the edge of the short exit V-chuck where it falls into a waste disposal chute. Trailing edge end trims are done the same way.

The second method uses a powered scrap gate between the blades which "opens" and "closes" to allow end trims to fall into a disposal chute. A proximity switch on the base of the saw detects a metal bracket on the pusher and tells the scrap gate to open when the leading end trim of the log is under the blades. After the cut, the scrap gate closes and remains closed for cutting the remaining pieces. When a new log is to be cut, the last piece of the log which was just cut is pushed out of the way by the incoming log and the proximity switch again detects the metal bracket on the pusher and the scrap gate opens and allows the end trim to fall into the waste disposal chute.

Pieces can be removed from the cutting area by a take-out mechanism, for example a take-out mechanism which uses inflatable air bladders to grip the piece. The take-out "grabs" the pieces from the short V-chuck section after the blades, turns it vertically, passes it through an air-powered saw dust cleaning mechanism, and places it either on a stationary surface, rotating table, or moving conveyor. If a cookie is cut with each piece, the take out mechanism removes the piece and cookie from the V-chuck, turns them into a vertical orientation, separates the piece and cookie by expanding the take-out arms about one inch, passes them through the dust cleaner, contracts the take-out arms, and sets them on the desired surface. The take-out can either be a small robotic system or a mechanical pick and place unit.

Dust collection vents are preferably placed in various areas of the saw, the blades, and/or the take-out device in order to collect the dust generated.

In another aspect, the present invention relates to a method of manufacturing a ceramic article from a log having a longitudinal axis, the method comprising transversely cutting at least one piece from the green log by simultaneously cutting into the log at a plurality of spaced apart locations along the length of the log.

The method can further preferably comprise grinding the piece, wherein the at least one piece is in a green state. Preferably, wherein the at least one piece is held in place during the grinding.

In some embodiments, subsequent to the cutting, the first piece is moved by the remainder of the log from which the first piece was cut. In some embodiments, subsequent to the cutting, the first piece is moved by another log.

In some embodiments, the first piece is cut from the log while the log is substantially horizontal. In some embodiments, the first piece is rotated 90 degrees after being cut from the log.

In some embodiments, only kerf is cut from the log at one of the spaced apart locations.

In some embodiments, a first piece is transversely cut from the log by simultaneously cutting into the log at first and second locations spaced apart along the length of the log, wherein the first piece comprises opposing first and second transverse surfaces. In some embodiments, the first piece is transversely cut from the log by a first blade and a second blade simultaneously cutting into the log at the respective first and second locations. In some embodiments, the first and second blades are mounted on respective first and second spindles linked together by a linkage, wherein the first piece is formed by a single stroke of the linkage resulting in contact between the first and second blades and the log. In some embodiments, the first and second blades are movable in respective parallel planes.

In some embodiments, the method further comprises grinding the first transverse surface of the first piece while the first transverse surface is proximate the first location. In some embodiments, the method further comprises grinding the second transverse surface of the first piece while the second transverse surface is proximate the second location. In some embodiments, the method further comprises simultaneously grinding the first and second transverse surfaces of the first piece.

Preferably, at least one of the first and second blades comprises a transverse grinding surface capable of contacting a transverse surface of the first piece.

In some embodiments, the first and second blades comprise first and second transverse grinding surfaces, respectively, and at least one of the first and second transverse grinding surfaces contacts the first piece while the first transverse surface is proximate the first location and the second transverse surface is proximate the second location to grind the first and second transverse surfaces. In some embodiments, the first and second blades are spaced apart by a first distance during cutting of the first piece, and the first and second blades are spaced apart by a second distance during the grinding, wherein the first distance is larger than the second distance.

In some embodiments, the first and second blades are indexed toward each other after the first piece is cut to allow the first and second transverse grinding surfaces to contact the first and second transverse surfaces, respectively.

Preferably, the first piece is held in place during the grinding.

The first piece can be moved from between the first and second blades by advancement of the remainder of the log from which the first piece was cut. In some embodiments, the first piece is moved from between the first and second blades by advancement of a second green log.

In some embodiments, the log is formed from extruding a plasticized mixture comprised of ceramic precursors into an elongated extrudate having the longitudinal axis, and the log is transversely cut from the elongated extrudate. In some embodiments, the log is dried prior to the first piece being cut therefrom. In some embodiments, after the piece is cut from the log, the first piece is heated for a time and a temperature sufficient to cause the first piece to transform into a ceramic article.

The invention claimed is:

1. A method of manufacturing a ceramic ware, the method comprising:

transversely cutting a piece from a ceramic-type log having a longitudinal axis by cutting into the log at spaced apart first and second locations along its length with first and second spaced apart blades each having an outer cutting edge and a side with a grinding surface to form first and second cut transverse surfaces on the piece; and grinding the first and second cut transverse surfaces with the respective grinding surfaces of the first and second blades by index the first and second blades toward each other while the first and second blades are respectively proximate the first and second locations.

2. The method of claim 1 wherein the first and second cut transverse surfaces have respective first and second surface finishes, and wherein the grinding is carried out to improve the first and second surface finishes of the piece.

3. The method of claim 2 wherein the grinding is carried out to establish an accurate dimension for the piece.

4. The method of claim 1 wherein the grinding surface comprises abrasive regions and non-abrasive regions.

5. The method of claim 4 wherein the abrasive regions and non-abrasive regions form a pattern.

6. The method of claim 1 wherein the first and second blades are moved forward from a ready position to a forward position to cut the piece, and wherein the first and second blades are moved backward from the forward position to the ready position after the piece is cut, and wherein the grinding of the first and second cut transverse surfaces occurs before the first and second blades are moved backward.

7. The method of claim 6 wherein the grinding occurs before the first and second blades are moved back to the ready position.

8. The method of claim 6 wherein the first and second blades move between the ready position and the forward position at a plurality of angular speeds.

9. The method of claim 1 wherein the first and second blades cut into the log simultaneously.

10. The method of claim 1 wherein the first and second blades grind the first and second cut transverse surfaces of the piece simultaneously.

11. The method of claim 1 wherein the log is a green ceramic-forming log.

12. An apparatus for manufacturing ceramic ware, the apparatus comprising:

means for transversely cutting a piece from a ceramic-type log having a longitudinal axis, including first and second spaced apart blades each having an outer cutting edge for cutting into the log at a location along the length of the log to form a cut transverse surface on the piece, wherein each cut transverse surface has a surface finish;

wherein each blade includes means for grinding the corresponding cut transverse surface with a side of the blade; and indexing means for bringing respective sides of the first and second blades into contact with the corresponding transverse surface to establish one of i) an accurate dimension of the piece and ii) an improvement to the surface finish of the corresponding cut transverse surface.

13. The apparatus of claim 12 wherein the side the each blade comprises abrasive regions and non-abrasive regions.

14. The apparatus of claim 13 wherein the abrasive regions and non-abrasive regions form a pattern on the side of each blade.

15. The apparatus of claim 12 further comprising means for moving the first and second blades forward from a ready position to a forward position to cut the piece, and for moving the first and second blades backward from the forward position to the ready position after the piece is cut.

16. A method of cutting and polishing a ceramic log, comprising:

transversely cutting a piece from the ceramic log having a longitudinal axis by cutting all the way through the log with first and second outer cutting edges of a first and second spaced-apart blades at a respective first and second spaced-apart locations along a length of the log to form first and second cut transverse surfaces on the piece, with reach first and second cut transverse surface having a surface finish; and grinding the first and second cut transverse surfaces with a respective first and second sides of the first and second blades by longitudinally indexing the first and second blades toward the piece to bring the first and second sides of the first and second blades into contact with the first and second cut transverse surfaces of the piece to perform at least one of i) improving the surface finish of the first and second cut transverse surfaces, ii) establishing an accurate length of the piece, and iii) establishing an accurate dimension of the piece.

* * * * *